US009958243B2

(12) United States Patent
Motyka et al.

(10) Patent No.: US 9,958,243 B2
(45) Date of Patent: May 1, 2018

(54) FIREARM AMMUNITION, SELF-DESTRUCTING PROJECTILES, AND METHODS OF MAKING THE SAME

(71) Applicant: PURDUE RESEARCH FOUNDATION, West Lafayette, IN (US)

(72) Inventors: Roman Motyka, West Lafayette, IN (US); Juan F. Rivera, Dyer, IN (US); Seung-Yun Song, West Lafayette, IN (US); Rachel Jean Stone, Troy, IL (US); Ryan Brent Thompson, Fort Wayne, IN (US); Esteban Ernesto Marinero-Caseres, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 16 days.

(21) Appl. No.: 15/137,917

(22) Filed: Apr. 25, 2016

(65) Prior Publication Data

US 2016/0313102 A1 Oct. 27, 2016

Related U.S. Application Data

(60) Provisional application No. 62/153,380, filed on Apr. 27, 2015.

(51) Int. Cl.

| | |
|---|---|
| ***C06B 45/10*** | (2006.01) |
| ***F42B 12/74*** | (2006.01) |
| ***F42B 33/00*** | (2006.01) |
| ***F42B 8/14*** | (2006.01) |

(52) U.S. Cl.

CPC ..... *F42B 12/74* (2013.01); *F42B 8/14* (2013.01); *F42B 33/00* (2013.01)

(58) Field of Classification Search

USPC ..... 149/19.5, 17, 18, 19.1, 109.4

See application file for complete search history.

(56) References Cited

U.S. PATENT DOCUMENTS

| | | | | |
|---|---|---|---|---|
| 7,770,521 | B2 * | 8/2010 | Williams | F42B 12/22 102/364 |
| 2002/0152914 | A1 * | 10/2002 | Cox | F42B 12/36 102/501 |

* cited by examiner

*Primary Examiner* — James E McDonough

(74) *Attorney, Agent, or Firm* — Hartman Global IP Law; Gary M. Hartman; Domenica N. S. Hartman

(57) ABSTRACT

Firearm ammunition, projectiles and method of making such projectiles. The projectiles include a body formed of composite material with at least one particulate material dispersed in a matrix material, a cavity in the body, and a heat source located in the cavity of the body. During flight of the projectile, the heat source increases the temperature of the matrix material such that the body at least partially disintegrates after the projectile travels a distance or period of time after being fired (propelled) from a firearm.

13 Claims, 13 Drawing Sheets

STEP 2

STEP 1

FIREARM AMMUNITION, SELF-DESTRUCTING PROJECTILES, AND METHODS OF MAKING THE SAME

CROSS REFERENCE TO RELATED APPLICATIONS

This application claims the benefit of U.S. Provisional Application No. 62/153,380, filed Apr. 27, 2015, the contents of which are incorporated herein by reference.

BACKGROUND OF THE INVENTION

The present invention generally relates to ballistic projectiles. The invention particularly relates to bullets capable of transitioning from lethal to less lethal or nonlethal after the bullet travels a distance or period of time after being fired (propelled) from a firearm.

Conventional cartridge ammunition comprise a cartridge casing, a projectile (bullet), and a propellant charge within the casing that expels the bullet from the casing. Current bullets for firearms are made of a variety of materials depending on their intended application. The most common bullet material is lead, which has a combination of low hardness, low cost, and high density, making it a practical material for most bullet applications. FIGS. 1 and 2 are plots representing hardness vs. density and price vs. density, respectively, for a variety of common bullet materials. A bullet formed of a material having relatively low hardness, such as lead, promotes deformation of the bullet upon impact, thereby transferring a greater amount of energy to its target than a bullet formed of a material having a higher hardness. In contrast, if piercing is desired, the bullet may be formed of a material having relatively high hardness, such as tungsten or depleted uranium, or may include a jacket encasing the low hardness material, called a full metal jacket, commonly formed of copper, copper alloys, or certain grades of steel. High density materials are preferred to maximize the momentum and kinetic energy of a bullet, which results in improved accuracy and stopping power. If toxicity is a concern, materials such as copper-tin alloys or bismuth may be practical alternatives to more toxic materials, such as lead. Standard bullets are commonly produced either by an extrusion and pressing process or by a casting process. For example, in mass production, a lead billet can be extruded into lead wire, which is cut into sections and pressed into a bullet-like shape to form a lead bullet. Casting processes are more typically used to produce small batches of bullets.

Standard bullets, generally comprising a solid body formed of a high-density material such as those identified in FIGS. 1 and 2, retain a significant portion of their energy after traveling hundreds or even thousands of meters. Consequently, there is a risk for unintended and collateral damage because bullets may maintain lethality until they reach their maximum range or impact a person or object (which raises the risk of shrapnel). There is a particular concern for unintended death or injury of bystanders and collateral damage when a target is missed. Hence, there is a definitive need in the law enforcement, military, and civilian sectors for a bullet that is capable of significantly reducing unintended damage, which would enable police officers, soldiers, and citizens to more confidently and safely wield their firearms offensively, defensively, and recreationally.

Several solutions have been proposed that render bullets non-lethal or less lethal. These solutions include frangible bullets, self-destructing bullets, and non-lethal alternatives such as rubber or plastic bullets.

Frangible bullets are configured to break apart upon impact and are therefore intended to reduce the likelihood that the bullet will penetrate or damage a wall, building, or the like. There are multiple types of frangible ammunition. One type includes a bullet formed of a sintered metal powder. As these bullets are not a solid piece of metal, and instead contain porosity or cavities, they are more likely to disintegrate upon impact with a solid object, and less likely to travel through objects, such as thick drywall or wood, depending on the bullet design. Ammunition of this type is disclosed in U.S. Pat. No. 8,225,718 to Joys et al., the contents of which are incorporated herein in its entirety.

A second type of frangible bullets is similar to hollow point ammunition (a standard type of bullet with a hollowed out tip that deforms easier in order to impart more energy to the target), but with the head of the bullet full of pellet shot instead of being hollow. For example, the bullet may include a scored jacket with a plastic tip, securing compressed shot within the jacket. Upon impact the plastic tip is forced rearward into the bullet, causing the jacket to fracture along the score marks and release the compressed shot therein. Release of the shot disperses the mass of the bullet, allowing it to transfer its energy quickly and thus reducing the likelihood that it will pierce through walls.

U.S. Patent Application Publication No. 2002/0152914 to Cox discloses a self-destructing bullet that comprises a body portion having a leading end, a base portion spaced apart from the leading end, and a hollow chamber defined within the body intermediate the leading end and base portions thereof. The body of the bullet is formed of a low temperature melting point metallic material. A catalyst, comprised of a high temperature combustible material, is positioned within the hollow chamber of the bullet. A combustible fuse extends from the base portion of the bullet to engage the catalyst. When assembled in a cartridge and fired from a firearm, the propellant charge of the cartridge will ignite the fuse of the self-destructing bullet. After the bullet has traveled for a predetermined period of time the fuse ignites the catalyst, and once ignited, the catalyst in turn combusts and melts or consumes the metallic material which comprises the body of the bullet to accomplish the self-destruction of the bullet.

While the above-noted types of bullets represent advances in non-lethal or less-lethal ammunition, improvements are still necessary. For example, though frangible bullets may reduce or even eliminate the potential for creating shrapnel, they must collide with an object in order to fragment. Prior to impact with an object, the bullets can maintain their lethality during travel (flight) similar to standard bullets, creating the possibility of hitting bystanders. Self-destructing bullets commonly disintegrate by explosion giving rise to shrapnel, whose momentum, size and shape can still inflict significant damage or death on unintended bystanders or collateral damage. Nonlethal alternatives such as rubber or plastic bullets do not contain the stopping power police force need to take down an intended target and they are designed to impact in the same fashion as standard lethal bullets, albeit with lesser momentum and less harmfully.

In view of the above, there is an ongoing desire for bullets having the stopping power and lethality of standard bullets, the shrapnel-eliminating benefits of frangible bullets, and the capability for reducing the risk of collateral damage and bystander injury or death.

BRIEF DESCRIPTION OF THE INVENTION

The present invention provides firearm ammunition, projectiles, and methods for manufacturing projectiles capable of reducing the risk of injury and collateral damage by rendering the projectile less lethal or nonlethal after a predetermined flight time or flight distance.

According to one aspect of the invention, a projectile includes a solid body formed of composite material with at least one particulate material dispersed in a matrix material, a cavity in the body, and a heat source located in the cavity of the body. Upon activation the heat source generates heat and increases the temperature of the matrix material such that the body at least partially disintegrates after a predeterminable time period and the particulate material is no longer held together in a single mass.

According to another aspect of the invention, a method of making a projectile includes combining a particulate material and a matrix material to form a composite material comprising the particulate material suspended within the matrix material, producing a solid body formed of the composite material, and locating a heat source within the body. Upon activation the heat source generates heat and increases the temperature of the matrix material such that the body at least partially disintegrates after a predeterminable time period and the particulate material is no longer held together in a single mass.

According to another aspect of the invention, a firearm ammunition includes a casing, a propellant within the casing, and a solid body configured to be propelled from the casing by the propellant upon ignition of the propellant. The solid body is formed of a composite material with at least one particulate material dispersed in a matrix material. Heat generated by ignition of the propellant and air friction during flight of the projectile increase the temperature of the matrix material during flight of the projectile such that the body at least partially disintegrates after a predeterminable time period and the particulate material is no longer held together in a single mass.

Technical effects of the method, projectile, and firearm ammunition described above preferably include the ability to render initially lethal projectiles less lethal or nonlethal after the projectile travels a distance or period of time after being fired (propelled) from a firearm.

Other aspects and advantages of this invention will be better appreciated from the following detailed description.

DETAILED DESCRIPTION OF THE INVENTION

The present invention generally provides self-destructing projectiles that are initially lethal and once projected, deployed, propelled, etc., as a result of being fired from a firearm, will travel a distance or period of time unhindered in air, will disintegrate in a non-explosive manner and rendered less lethal or nonlethal. In particular examples, composite bullets are described herein that are formed of two or more materials that undergo thermally-activated degradation over a controllable period of time. The degradation may be activated by heat generated by the ammunition firing process, air friction, an internal transient heat source, or a combination thereof.

Figure 1:
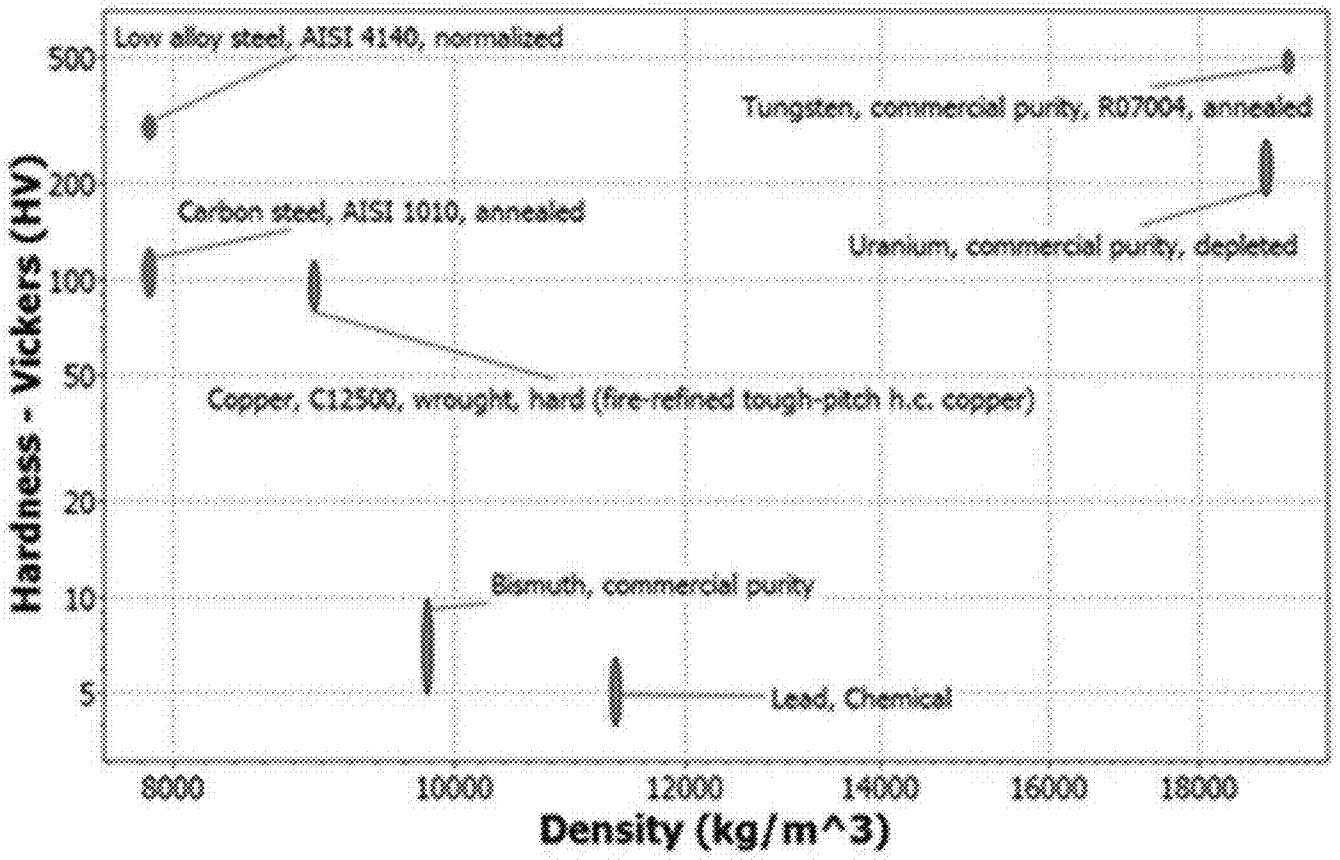
FIG. 1 is a plot of hardness vs. density for selected common bullet materials.
Figure 2:
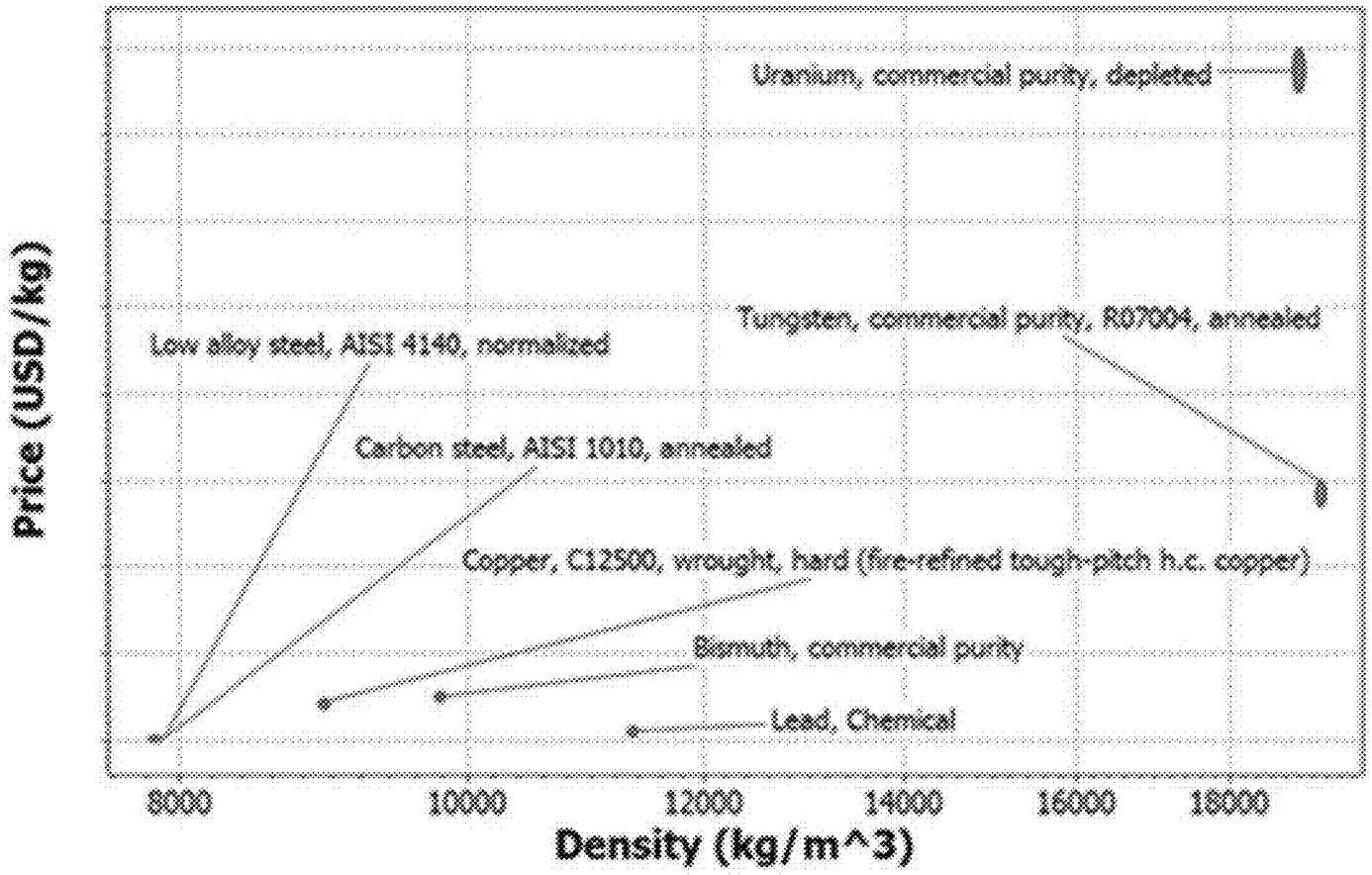
FIG. 2 is a plot of price vs. density for selected common bullet materials.
Figure 3:
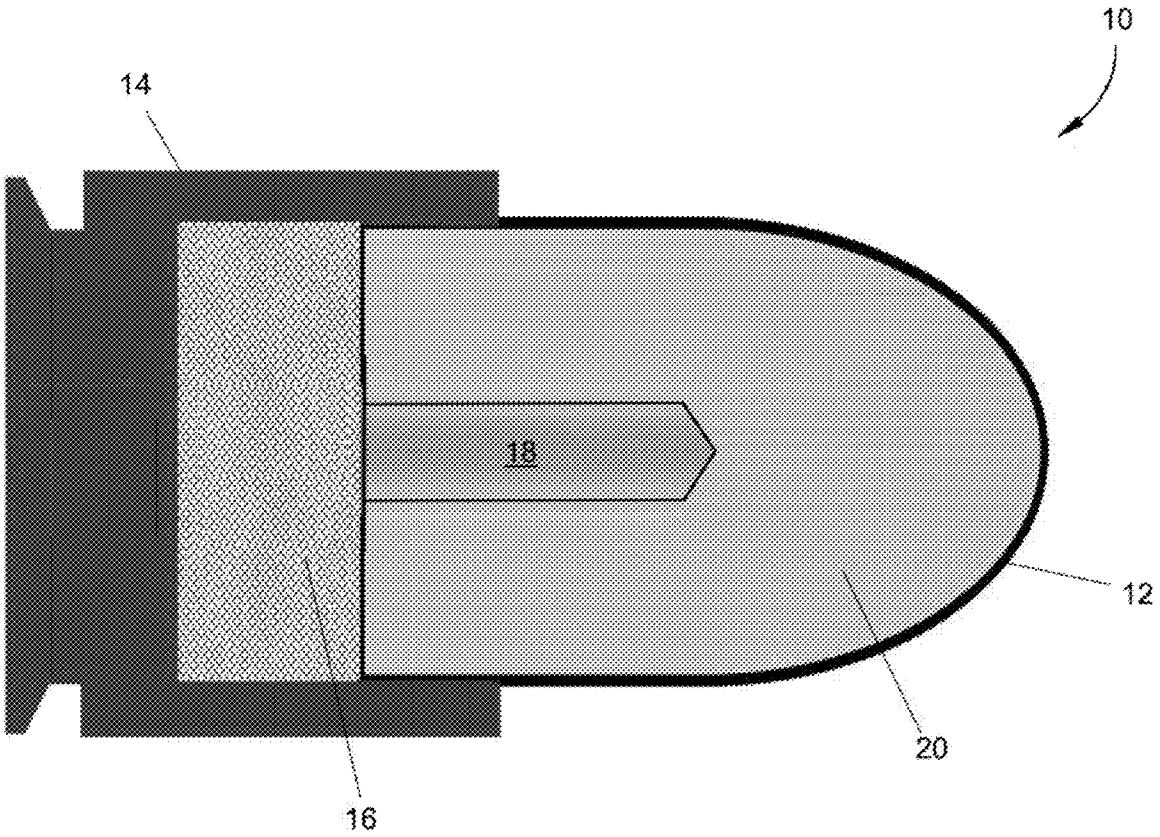
FIG. 3 schematically represents a bullet in accordance with a nonlimiting embodiment of the present invention.

FIG. 3 schematically represents a nonlimiting embodiment of a bullet (projectile) 12 formed of a composite material 20 configured to thermally disintegrate after traveling a predeterminable distance or period of time after being fired (propelled) from a firearm, such that the bullet 12 is no longer a single mass but instead is reduced to less lethal or nonlethal fragments and/or particles. The bullet 12 comprises an optional but preferred internal transient heat source 18 that aids the disintegration process. As common in the art, the bullet 12 is represented as part of a cartridge 10 comprising the bullet 12, a case 14, and a propellant 16 (for example, gunpowder). Although not shown, the cartridge 10 may include a primer for igniting the propellant 16. In this embodiment, the internal heat source 18 is configured to activate upon ignition of the propellant 16 and generate enough heat as the bullet 12 travels in flight to cause disintegration of the bullet 12 under the force of air resistance after a predetermined time or distance.

In order to accomplish thermal disintegration of the bullet 12 during flight, the composite material 20 is produced to comprise particulates of a first material having a density suitable for such a projectile, for example, such that the average density by volume of the bullet 20 is similar to materials used in conventional bullets, in order to provide sufficient momentum and stopping power and thereby have a lethality similar to conventional bullets of the same caliber (an impact energy of about 100 Joules is considered herein as a minimum for being lethal). Preferably, the first material has a relatively high thermal conductivity in order to facilitate the conduction of heat from the internal heat source 18 throughout the body of the bullet 12. The first material is contained within a matrix formed of a second material that has a relatively low melting point to enable the degradation of the bullet 12 at the temperatures reached by the bullet 12 when fired due to the heat of the propellant 16, the internal heat source 18, and air friction. As an example, the first material of the composite material 20 may include particles of a metal or alloy, for example, of the types commonly used in standard bullets, maintained in a low melting temperature matrix formed by the second material, for example, a binder material that adheres the particles of the first material together to form a single mass. Although the composite material 20 may be a two-phase system consisting of the first and second materials, it is foreseeable and within the scope of the invention that the composite material 20 may comprise materials in addition to the first and second materials, or the first and/or second materials may be individually formed by multi-component compositions. For example, the composite material 20 could include particles of two or more metals or alloys chosen based on, for example, their thermal conductivity, hardness, and/or density, both contained in the matrix (second) material formed by a binder material. Preferably, if the bullet 12 impacts a hard surface before it disintegrates into fragments or individual particles of the first material as a result of the heat source 18, it is capable of being disintegrated from the impact rather than creating relatively large shrapnel of the type created by standard bullets.

A nonlimiting example of the composite material 20 includes a two-phase system comprising a powder of copper or an alloy thereof (the first material) contained in a low melting point binder material (the second material). Copper has a relatively high thermal conductivity, mid-range density, and mid-range price making it an attractive choice for the first material of the bullet 12. An exemplary binder material is polylactic acid (PLA) with, for example, about 30% glass fiber. While other binders can also be used (in addition to or separate of PLA), PLA with about 30% glass fiber has a particularly low melting point, and the glass fiber promotes improved fracture strength and thermal conductivity. Nonlimiting examples of other binder materials include bismuth-tin (BiSn) alloys due to their higher thermal conductivity, mechanical strength, and similar melting point compared to PLA. In this example, the internal heat source 18 is configured to generate enough heat to either melt or induce a glass-phase transition of the binder material, leading to the complete disintegration of the bullet 12 (i.e., into individual particles of the first material) or partial disintegration of the bullet 12 (i.e., into fragments formed of particulates of the first material that remain adhered to each other) during flight under the force of air resistance after the bullet 12 has traveled a predetermined time or distance, and the release of the particulates contained therein.

The internal heat source 18 may be any source of heat, including but not limited to a fuse, capable of producing an exothermic reaction upon activation. Preferably, the reaction generates relatively large amounts of heat with little or no gas emission. Suitable reactions include but are not limited to oxidation-reduction reactions. By limiting the amount of gas produced by the internal heat source 18, the structure of the bullet 12 is less limited by shape, the disintegration of the bullet 12 is non-explosive, the accuracy of the bullet 12 will preferably not be effected, and the distribution of heat throughout the bullet 12 is promoted. Nonlimiting examples of suitable internal heat sources includes an aluminum-nickel powder fuse or a titanium-carbon powder fuse.

The predetermined time period for disintegration of the bullet 12 upon firing may be selected by controlling several parameters such as the proportions of the first and second materials, nature of the internal heat source 18 (for example, shape, surface area, heat production rate, etc.), dispersion of the particles in the binder, surface area of the particles of the first material, and various other parameters. For example, the volumetric mass distribution of the composite material 20 is preferably selected to provide additional control of the time for disintegration of the projectile (bullet 12). As an example, in some teachings of the invention, particulates of the first material may be homogeneously dispersion in the second material, whereas in other instances, particulates of the first material may be dispersed in the second material so as to form regions of only the first material or only the second material. It is believed that by varying the above noted parameters, the time period for disintegration can be tuned to meet the specifications of a particular application. Generally, a specific time period may be chosen based on the expected flight speed of the bullet 12 and the desired lethal range of the bullet 12. It is foreseeable that the bullet 12 may be configured to disintegrate at any instant over the entire course of its flight. For example, if the bullet 12 is formed as a 0.45 caliber bullet and is expected to have a firing velocity of about 250 m/s, a time period of about 0.2 second may be chosen to cause disintegration of the bullet 12 after it has traveled about 50 meters. This would allow the bullet 12 to remain lethal within about the first 50 meters of its flight and then render the bullet 12 nonlethal soon thereafter, reducing the likelihood of unintended bystander casualties and collateral damage. It is foreseeable that such preferred time periods and distances may be based on statistics relating to bystander casualties and/or collateral damage relating to, for example, past discharges of police firearms.

Figure 4:
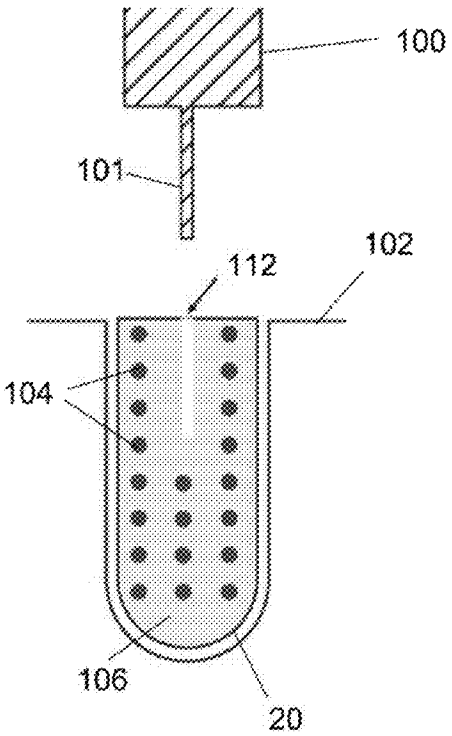
FIG. 4 schematically represents a compression molding process in accordance with certain aspects of the present invention.
Figure 4:
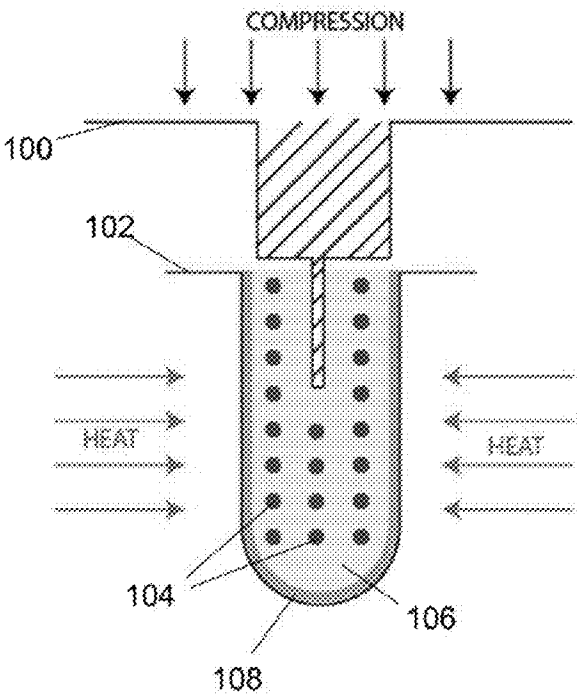

The bullet 12 represented in FIG. 3 (as well as the wide range of other potential projectile configurations within the scope of the invention) may be produced using various manufacturing technique, such as but not limited to compression molding processes. FIG. 4 schematically represents a nonlimiting compression molding process performed on a mixture comprising a particulate material 104 dispersed in a binder material 106. During the molding process, a male mold 100 exerts a mechanical pressure on the mixture, which is contained in a cavity of a female mold 102 that provides support and is capable of sufficiently conducting heat to melt the binder material 106. The cavity of the female mold 102 is configured to produce a bullet of a desired shape upon compression of the composite material. The male mold 100 includes at least one feature 101 suitable for producing a recess 112 in the composite material 20 for insertion of the internal heating source therein. The cavity of the female mold 102 may be coated with a mold release agent 108 in order to facilitate removal of the composite material 110 after compression.

The bullet 12 may be formed to have any shape including but not limited to those commonly used for projectiles. In particular, compression molding processes provide the capability to create various shapes of projectiles for both improved effectiveness of the projectile prior to disintegration as well as to modify (promote or reduce) the heat generated through air friction. For example, external heat transfer to the bullet 12 can be modified by adjusting its surface morphology and materials composition. Consequently, the shape, texture, etc., of the bullet 12 may be configured to effect the time period for disintegration.

Nonlimiting embodiments of the invention will now be described in reference to experimental investigations leading up to the invention. In these investigations, test samples were prepared and analyzed in order to determine the viability of particulate-binder composite bullets as described herein. The test samples were produced using compression molding techniques to comprise smooth surface finishes appropriate for hardness, optical, and thermal testing. Some of the compression processing parameters considered were sample shrinkage during compression, heat and pressure applied during compression, and time spent at compression molding conditions.

A first of the three molds (Mold 1) included male and female molds that were used to compression mold samples in a manner similar to the process of FIG. 4. Mold 1 was constructed from aluminum 6061 for ease of fabrication, high mechanical properties, and good corrosion resistance. The female mold comprised multiple cavities therein suitable for simultaneously producing multiple bullets in a single compression process. Although not shown, Mold 1 included holes through the bottom of the female mold that were connected to each cavity to aid in releasing the sample after compression. The holes allowed for a tool or compressed air to be used to facilitate removal of the samples after compression by exerting a force from the bottom of the female mold. The depth of the cavities were configured to be longer than standard .45 caliber bullets, but could optionally be reduced to an equivalent size.

A second of the three molds (Mold 2) had a standard saucer-type die configuration. While this particular mold was only used to produce flat disc shaped samples, the mold was determined to be beneficial for testing purposes as the test samples could be produced quickly, easily removed, and only required minimal machining for hardness, SEM, and optical evaluation.

A third of the three molds (Mold 3) had a stainless steel pressing-type die configuration. The composite material was packed on top of a small cylindrical plug placed inside a larger hollow cylinder, and then compressed using a long rod. The test samples made with this die were uniform cylindrical samples with a smooth finish, which were appropriate for thermal testing.

In the investigations leading to the present invention, commercially purchased PLA particles as received were determined to be too large to use in the production of the sample bullets. In particular, the PLA would sediment when mixed with a copper powder (150 mesh, 105 μm) used in the investigations. In order to improve the likelihood of obtaining a homogenous mixture of the copper and PLA particles, the PLA particle size was reduced. In particular, the PLA was ground for approximately five minutes in a grinder. The PLA powder was then sifted through a 20 mesh screen to ensure the use of smaller particles (<841 μm).

Figure 5:
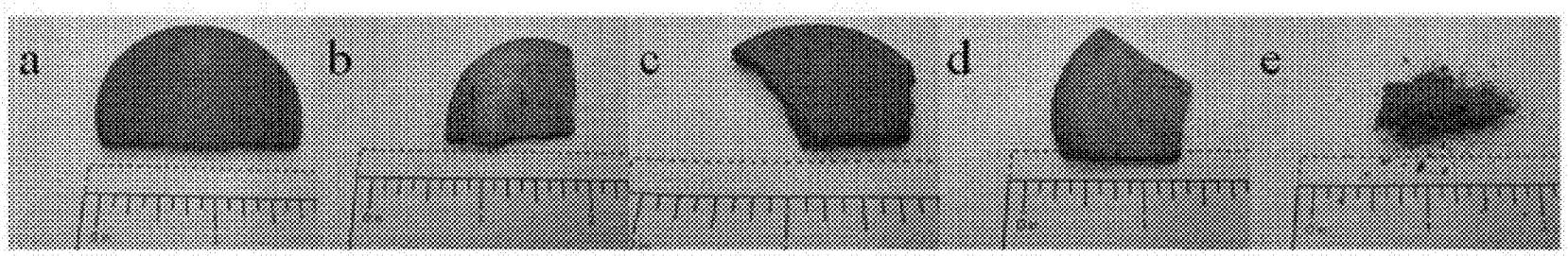
FIG. 5 shows scanned images of samples made using a saucer mold. The samples comprised polylactic acid (PLA) to copper ratios of: image (a) 1:0.55; image (b) 1:2; image (c) 1:3; image (d) 1:4; and image (e) 1:10.

The parameters used for hot pressing the copper powder and binder were the same all three molds. The hot press was preheated to 400° F. (about 204° C.). The die cavities of the female members of the molds were coated with a silicon-based lubricant and then filled with mixtures of the copper-PLA powders. The male members of the molds were then set in place and a cold press was used to compact the powder mixtures. After the powders were compacted, the molds were heated at 400° F. in the hot press for fifteen minutes at a pressure of 10,000 psi. Once cooled, the samples were removed. Due to complications in sample removal from Mold 1, Mold 2 was used to produce samples for hardness testing and optical characterization. Samples made using Mold 2 are shown in FIG. 5. The PLA to copper ratios of the test samples were as follows: image (a) 1:0.55, image (b) 1:2, image (c) 1:3, image (d) 1:4, and image (e) 1:10. Cylindrical samples specifically designed for thermal testing were made using Mold 3.

Suitable copper to PLA ratios for test samples were established by investigating ratios of very low copper to PLA and very high copper to PLA. The upper limit was initially determined when the sample either crumbled when being extracted from the mold or when hardness tests induced fracture. Once initial copper to PLA ratios were chosen and samples produced, hardness testing was performed to characterize the samples of varying PLA to copper ratios. It is not common to take hardness measurements on soft polymers due to the large amount of creep and deformation that can occur during testing. However, due to the amounts of copper mixed in the composite samples and nature of the product's application, hardness measurements were taken using the Rockwell B scale (HRB). Standard procedure for this hardness scale were followed including using a 100 kg application load and a 1/16" ball indenter. The testing results are outlined in Table 1 below.

TABLE 1

Comparison of Sample Hardness

| Sample: (PLA:Cu) | Sample 1 (1:0.55) | Sample 2 (1:2) | Sample 3 (1:3) | Sample 4 (1:4) | Sample 5 (1:10) | Lead (Pb) | Copper (Cu) |
|---|---|---|---|---|---|---|---|
| Average Hardness: | 10.5 HRB | 114 HRB | 80 HRB | N/A | N/A | N/A | 85 HRB |
| Qualitative Report: | did not show significant yielding | moderate amount of deformation | large amount of deformation | sample fractured during testing | sample didn't hold form; no testing done | too soft to measure in the HRB range | upper range of copper |

Comparisons were made to lead and copper, which are materials typically used in producing commercial bullets. The lead sample was too soft for hardness measurements in the HRB scale of the instrument used and the copper sample had a hardness value of approximately 85 HRB. Both quantitative and qualitative data were evaluated following the hardness characterization. Samples composed primarily of polymer showed large amounts of deformation and gave inaccurate readings, while samples composed principally of copper were too powdery to withstand the hardness load and subsequently broke part upon testing. With the hardness of the samples being greater than lead, it is believed that the samples (or bullets made from these materials) will likely survive travel through the barrel of a gun. In cases where the composite material chosen cannot survive travel through the barrel of a gun, methods to maintain such integrity are foreseeable. For example, in order to preserve the integrity and surface morphology of a bullet as described herein as it exits through a gun barrel, a coating material may be applied to exterior surfaces of the bullet. Such coating material would preferably disintegrate under thermal conditions similar to the second material, or otherwise release the first material upon disintegration of the second material.

Figure 6:
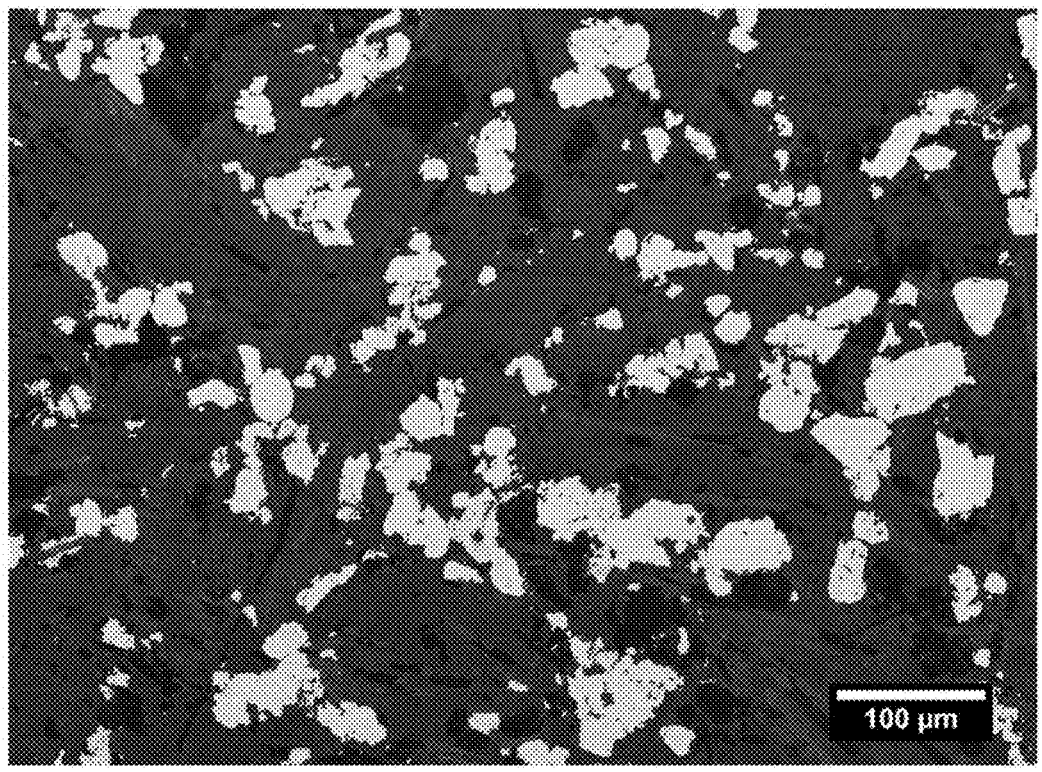
FIG. 6 is an optical image of a sample (T1) with a 1:1 PLA to copper ratio.
Figure 7:
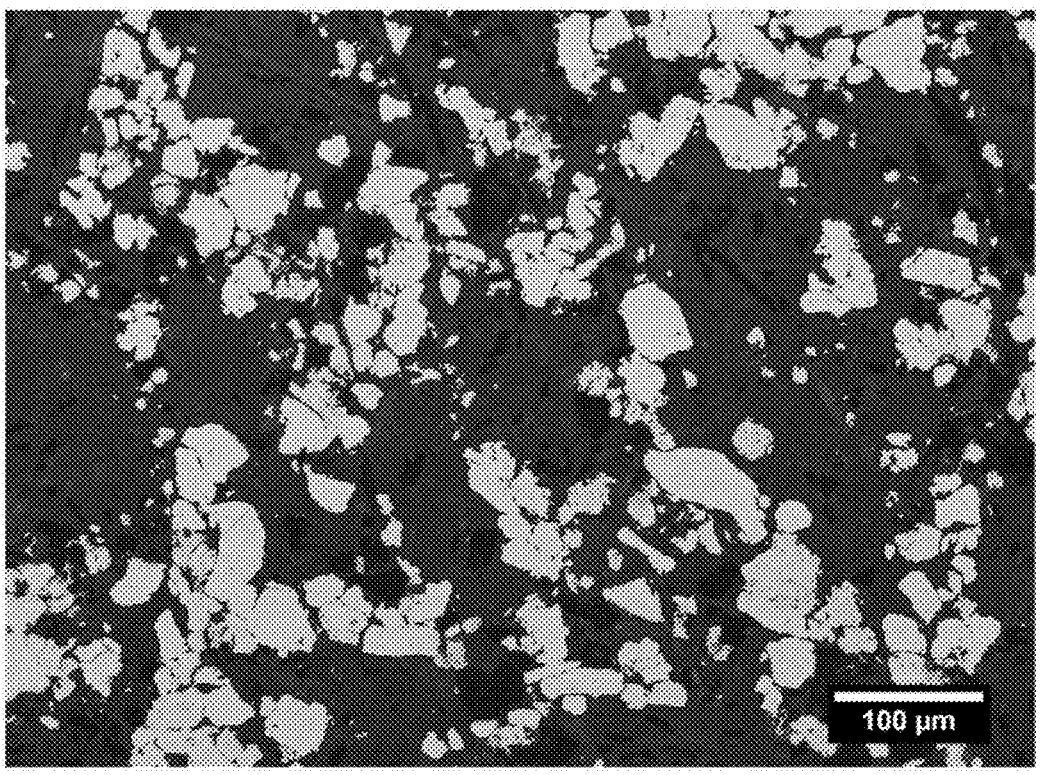
FIG. 7 is an optical image of a sample (T2) with a 1:1.5 PLA to copper ratio.
Figure 8:
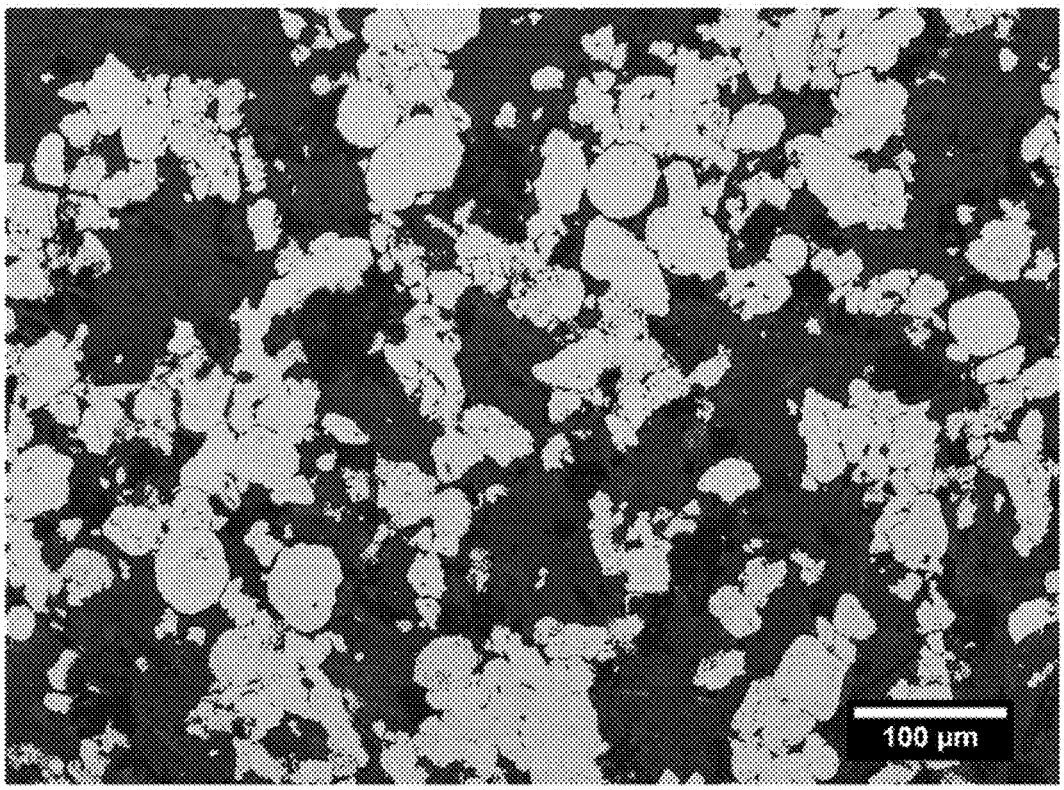
FIG. 8 is an optical image of a sample (T3) with a 1:2 PLA to copper ratio.

The copper to PLA ratio was further narrowed by analyzing optical micrographs to investigate the distribution of the metal particulates within the PLA binder. In particular, the goal was to determine a ratio that provided a sufficiently homogenous distribution of copper particles. As seen in the representative micrographs (FIGS. 6-8), the PLA fully surrounded the copper and successfully acted as a binder when sufficient amounts were present. However, the micrographs indicate that the mixture of copper and PLA was heterogeneous at all tested compositions. With heterogeneous samples, the thermal and mechanical properties become less predictable and reproducible. Specifically, large areas of only polymer severely limited heat transfer through the material as PLA has a much lower thermal conductivity than copper. It is foreseeable that improved mixing methods may be used to achieve a more homogenous particulate distribution such as those employed in the fabrication of composite materials. For example, it is believed that various common industrial mixing methods would provide more homogeneous mixing. For example, various industrial mixing methods may provide more rigorous dry mixing, or molten mixing and casting. The analysis of the optical micrographs allowed for the production of samples which were practical for thermal testing. The samples that underwent thermal testing had PLA to copper ratios of 1:1 (Sample T1), 1:1.5 (Sample T2), and 1:2 (Sample T3). Samples T1, T2, T3 were selected and prepared for thermal conductivity testing as these compositions were believed to be mechanically solid and dense enough to be lethal as a bullet, and provided the most homogeneous distribution of the copper particles of the ratios tested.

Figure 9:
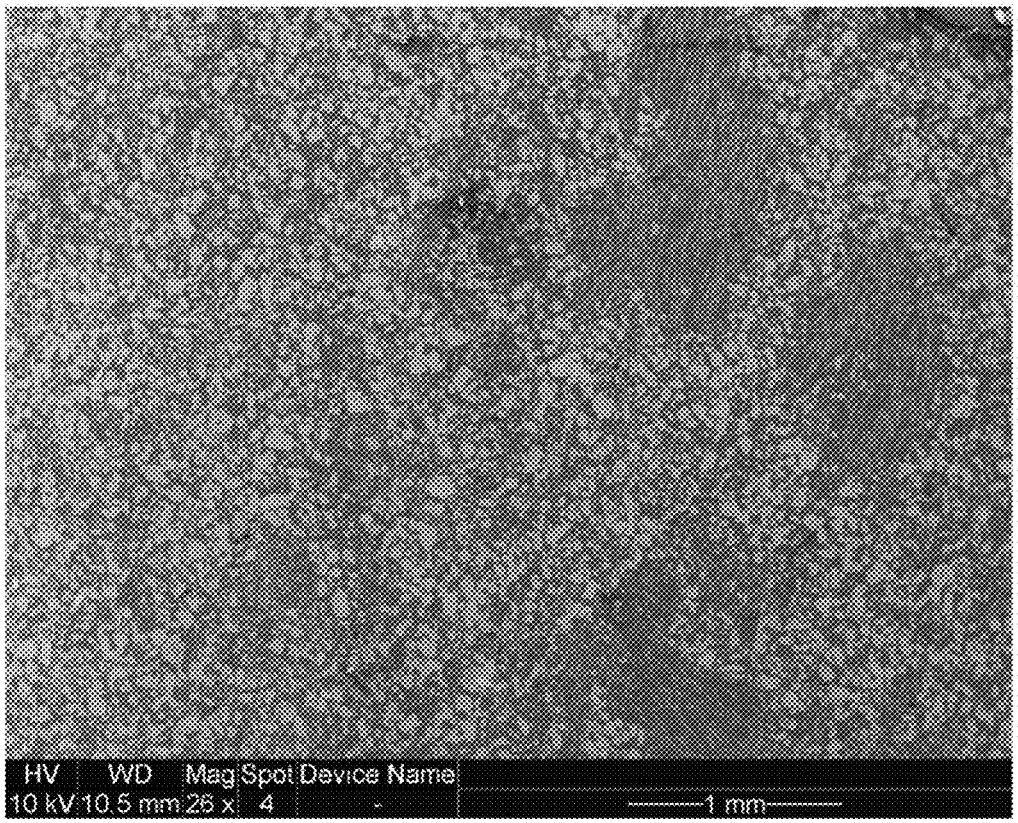
FIG. 9 is a scanned image of a scanning electron microscope (SEM) micrograph of a sample 7 from Table 1, showing areas of concentrated glass fibers.
Figure 10:
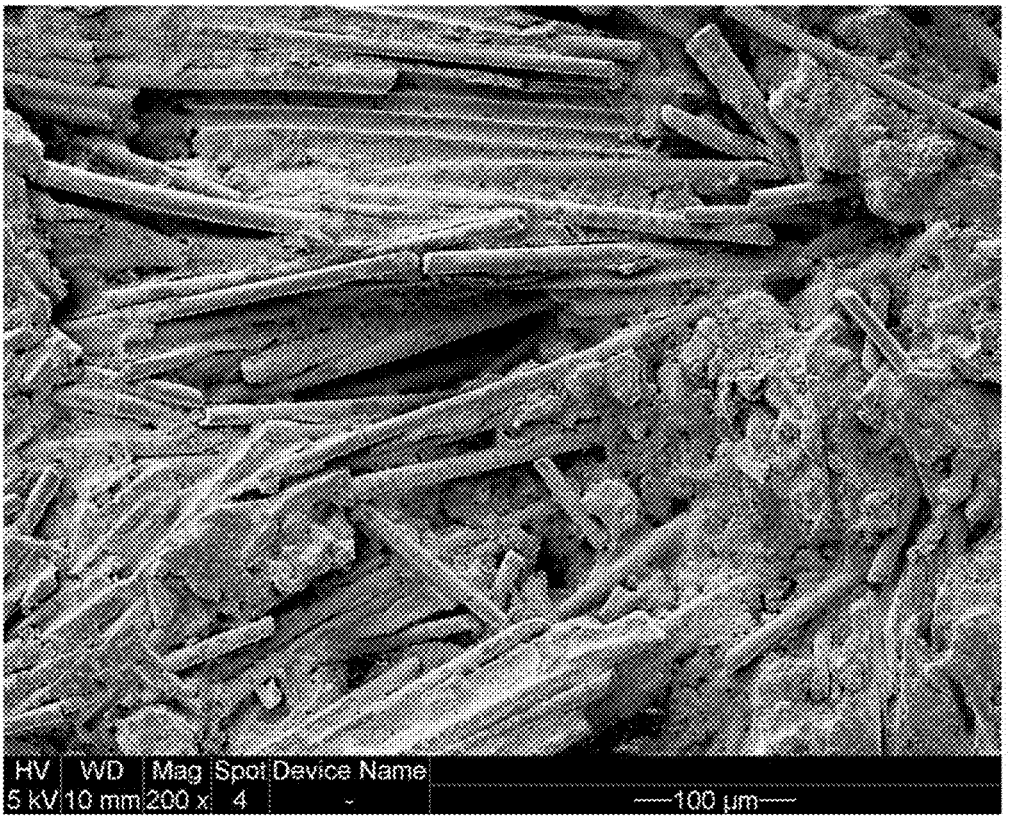
FIG. 10 is a scanned image of an SEM micrograph of a region of glass fibers from a sample 4 of Table 1.

Additional microstructure analysis was done using a scanning electron microscope (SEM). As shown in FIG. 9, groupings of glass fibers were present in the samples. A magnified view of a deep pit of these glass fibers can be seen in FIG. 10. It was unclear why these glass fibers grouped together in small isolated clusters as opposed to being homogenous throughout the mixture, although it is hypothesized to be a result of the mixing method or the hot pressing process used.

Figure 11:
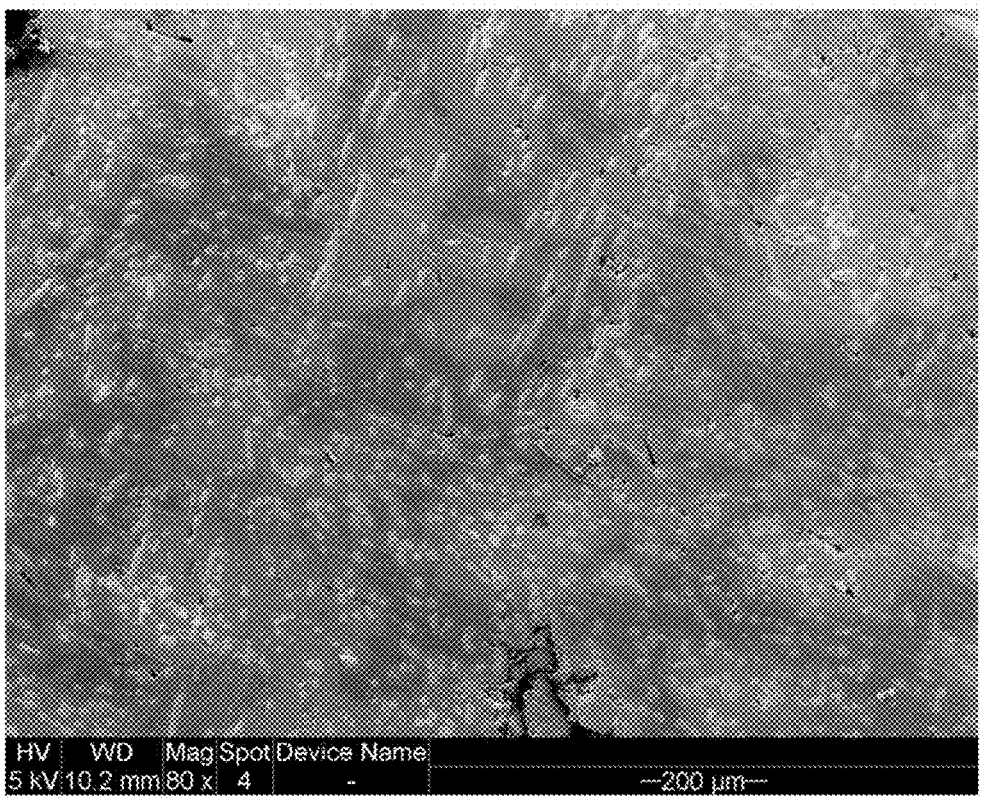
FIG. 11 is a scanned image of an SEM micrograph of pure PLA with 30% glass fibers that are anisotropically directed and exhibit a more homogeneous fiber distribution than other samples.

A pure 30% glass fiber PLA sample was made to compare the distribution of glass fibers to the 30% glass fiber PLA samples comprising the copper powder. As seen in FIG. 11, the glass fibers were relatively evenly distributed throughout the sample. The aggregations of glass fibers were aligned together, but the various aggregations were at random angles from each other. The variation of angles can be explained by the fact that the PLA originally came in small pellets which were ground up and mixed. Since the glass fibers are more homogeneously distributed in the pure PLA sample than the composite samples, the regions seen in the composite samples are likely due to the addition and mixing of copper powder.

Figure 12:
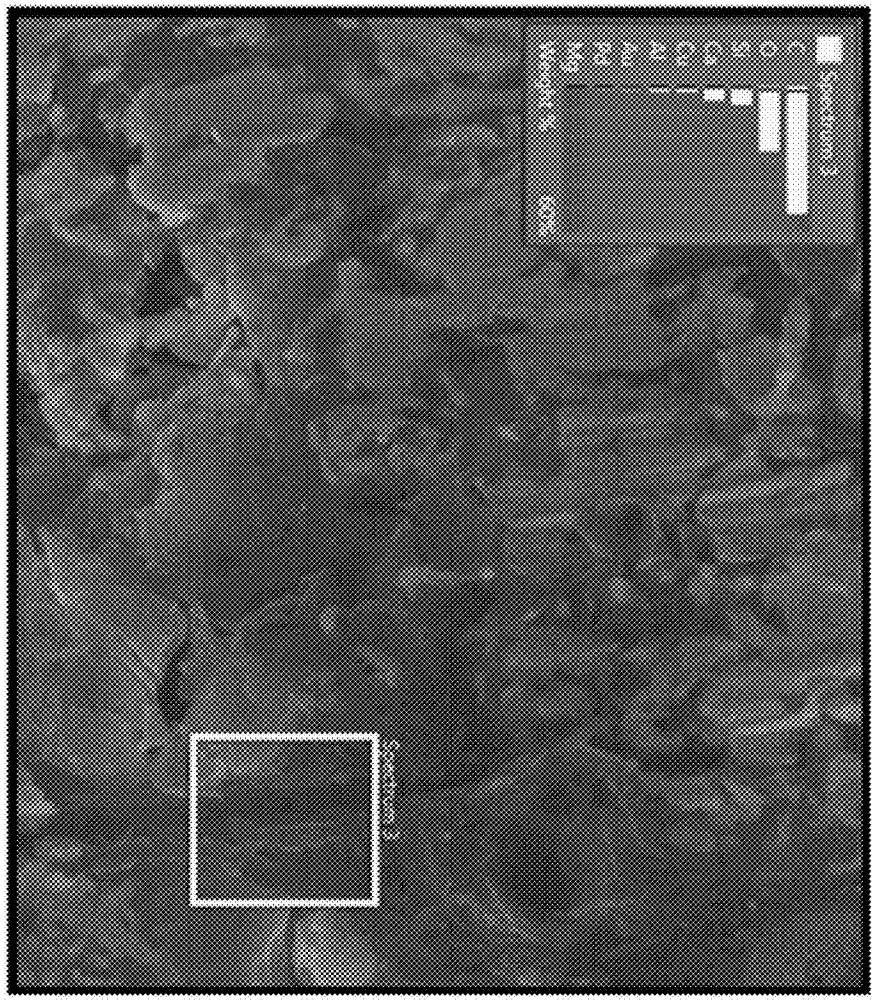
FIG. 12 represents energy-dispersive x-ray spectroscopy (EDX) analysis of a region labeled "Spectrum 3" of an SEM micrograph comprising an area with a glass fiber. The window in the upper left corner indicates the fiber's elemental composition.

Energy-dispersive x-ray spectroscopy (EDX) was performed on these samples and it was determined that the glass fibers are most likely a calcium silicate, due to findings of calcium and silicon in an area that contained a glass fiber, as seen in FIG. 12. The fiber may additionally have included aluminum oxide, although the aluminum reading on the EDX analysis may be a false peak, as the palladium and magnesium most likely were. The gold reading was due to a sputter coating of gold for the SEM imaging process.

In order to measure the thermal conductivity of the samples, a flash test was performed. A camera flash and two thermocouples were used in conjunction with a computer running LabVIEW for the experiment. A sample 10 mm in diameter and 3 mm tall was placed on a stage with a hole in the center to allow for the heat from the flash to be coupled through the bottom of the sample. One thermocouple was placed near the flash and the other was adhered to the top of the sample with a silver-based adhesive. Due to a communication delay between the thermocouples and the software, the flash was triggered at approximately 4 seconds after the initiation of the test via LabVIEW. Measurements of the heat produced by the flash were taken from both the bottom and top thermocouples. The sample was mounted on top of the flash source separated by 30 mm Temperature data were recorded and analyzed using a data acquisition system (NI PXI DAQ) with a 1000 Hz sampling rate.

Figure 13:
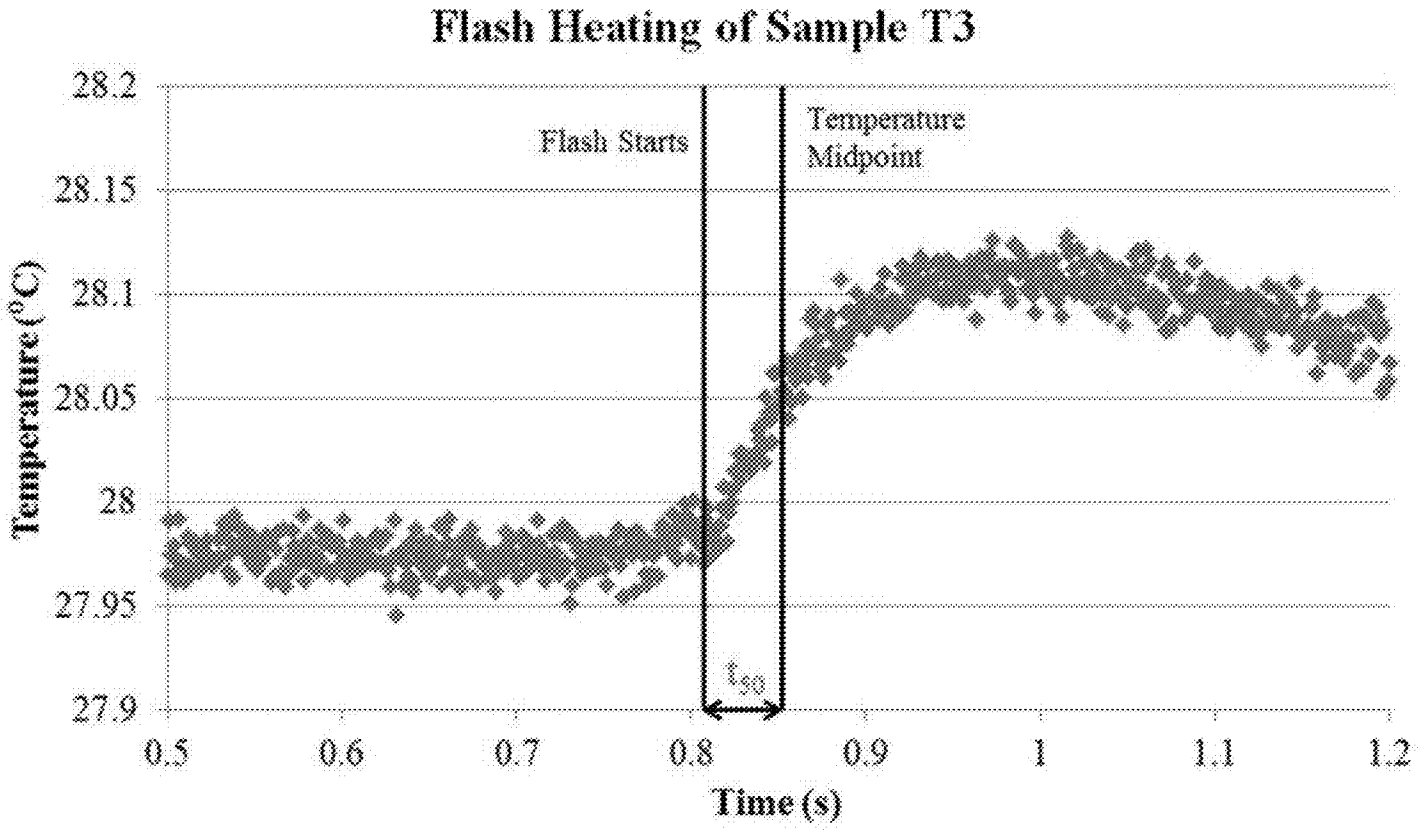
FIG. 13 is a plot representing flash heating data from the 1:2 PLA to copper sample of FIG. 8 with thermocouples at a sampling rate of 1000 Hz.

FIG. 13 shows temperature vs. time data for flash heating of a T3 sample (1:2 PLA:Cu). The key parameter from this measurement was the rise time, $t_{50}$, defined as half of the time that it takes the top of the sample to reach its peak temperature.

$$\alpha=0.1388\times h^2/t_{50} \quad \text{Equation 1:}$$

$$k=\alpha\times\rho\times c_p \quad \text{Equation 2:}$$

The thermal diffusivity ($\alpha$) can then be found using the Parker expression, shown in Equation 1, where h is the height of the sample. From there, the thermal conductivity (k) can be calculated using density ($\rho$) and specific heat capacity ($c_p$), as in Equation 2.

Table 2 below shows values obtained utilizing the flash testing method for the three different mass ratios of PLA:Cu. The thermal conductivity increased dramatically as the copper content was increased. This indicated that by changing the composition of the bullet, the disintegration time and the effective range of the bullet can be changed. However, if the copper content is too high, the composite sample will be too brittle, so both mechanical and thermal properties must be considered for the formulation of potential ratios for an intended bullet.

TABLE 2

Comparison of test sample densities, thermal diffusivity, and thermal conductivity.

| PLA:Cu (by mass) | Density (kg/m$^3$) | Thermal Diffusivity (mm2/s) | Thermal Conductivity (W/mK) |
|---|---|---|---|
| 1:1 | 2540 | 8.9 | 16.5 |
| 1:1.5 | 2910 | 20.5 | 40.4 |
| 1:2 | 3350 | 48.3 | 99.7 |

Modeling was performed on the heat generation of an aluminum-nickel powder fuse. While Al—Ni powder has a desirable density and thermal conductivity of 5.93 g/cc and 75 W/mK, respectively, in practice, these materials can be expected to have about 25-30% porosity, resulting in a density of about 4.15 g/cc and thermal conductivity of about 60 W/mK. The specific heat of the fuse is estimated to be about 0.65 J/gK, with a reactive heat generation of about 1 kJ/g. Lastly, the powder reacted at 1-D speeds of 200 mm/s. The modeling indicated that a 3 mm diameter, 8 mm long, cylindrical fuse weighing about 0.24 g would fully react to reach temperatures of about 430° C. in less than 30 ms. Of course, the heat generated by the fuse would be dispersed to the surrounding bullet material, resulting in a lower overall temperature. For instance, a composite 0.45 caliber bullet made of two-thirds copper and one-third PLA by mass would be expected to be heated to about 250° C. by the aforementioned 0.24 grams of AlNi fuse. Such a temperature increase would be expected to disintegrate the bullet as indicated by the formation of the test samples in a heated press at 204° C. as noted previously.

The above noted investigations indicated various aspects of the invention that are believed to be preferred. For example, a stainless steel die with interchangeable parts was determined to provide the most efficient production of compressed composite material. Results from hardness testing indicated that the copper-PLA samples have a higher hardness compared to lead, which supported the conclusion that these samples will most likely survive actual firing conditions. Thermal tests indicated that the thermal conductivity dramatically increases as more copper is introduced; however, when the ratio of copper to PLA was excessive, there was insufficient binding causing the samples to remain as loose powder. Optical microscopy and SEM analysis indicated a non-homogeneous mixture of the copper, PLA, and randomly oriented aggregates of aligned glass rod fibers. Based on these investigations, the most preferred composition for the copper/PLA bullets was determined to have a PLA to copper ratio of at least 1:2.

In view of the above description, self-destructing bullets as described herein represent ballistic projectiles that may be rendered less lethal or nonlethal after traveling a predetermined distance or time without the need to collide with an object. The non-lethality is accomplished by facilitating thermally-induced disintegration of the bullet into particles that are small enough so that their momentum and kinetic energy are insufficient or less likely to be lethal. The bullets are comprised of at least two materials having different physical properties, such as melting point, mechanical characteristics, and/or thermal conductivity. The disintegration process may be initiated by the heat generated during firing of the bullet and/or the heat of friction by air drag on the bullet. Particular embodiments of the invention include an internal source of heat to further control the speed of disintegration of the projectile.

Preferably, self-destructing bullets as described herein are capable if providing stopping power similar to a standard bullet of the same caliber within the intended effective range, while also becoming less lethal or nonlethal beyond the effective range. Such bullets may allow law enforcement officers to react confidently and efficiently in gunfight situations while minimizing unwanted casualties. In other words, bullets as described herein preferably combine the advantages of standard and frangible bullets while also self-destructing after a certain range without the need to collide with a solid object. By reducing the distance that the bullet maintains lethality and by having the bullet disintegrate during its flight time in air, the amount of damage caused to bystanders and property may be significantly reduced.

While the invention has been described in terms of specific embodiments, it is apparent that other forms could be adopted by one skilled in the art. For example, the physical configuration of the projectile could differ from that shown, and materials and processes/methods other than those noted could be used. Therefore, the scope of the invention is to be limited only by the following claims.

The invention claimed is:

1. A projectile comprising:

a solid body formed of a composite material with at least one particulate material dispersed in a matrix material wherein composite material has a ratio of the particulate material to the matrix material of 1:1 to 1:2, the body having a cavity therein; and a heat source located in the cavity of the body, the heat source being operable to be activated to generate heat and increase the temperature of the matrix material during flight of the projectile such that the body at least partially disintegrates after a predeterminable time period and the particulate material is no longer held together in a single mass.

2. The projectile of claim 1, wherein the heat source is activated by ignition of a propellant that propels the body into flight.

3. The projectile of claim 1, wherein the heat source provides heat through a reaction that does not create gas.

4. The projectile of claim 1, wherein the heat source creates an oxidation-reduction reaction to provide heat to the body during flight.

5. The projectile of claim 1, wherein the heat source is an aluminum-nickel powder fuse or a titanium-carbon powder fuse.

6. The projectile of claim 1, wherein the particulate material includes a material selected from the group consisting of copper, steel, bismuth, lead, tungsten, uranium, and their alloys.

7. The projectile of claim 1, wherein the composite material does not include lead.

8. The projectile of claim 1, wherein the heat source increases the temperature of the matrix material during flight of the projectile to a temperature above a melting temperature of the matrix material.

9. The projectile of claim 1, wherein the matrix material includes a binder material comprising a material selected from the group consisting of polylactic acid (PLA) and bismuth-tin alloy.

10. The projectile of claim 1, wherein the projectile is a bullet and the body has a hardness sufficient to survive being fired from a barrel of a gun.

11. A projectile comprising:

a solid body formed of a composite material with at least one particulate material dispersed in a matrix material, the body having a cavity therein; and a heat source located in the cavity of the body, the heat source being an aluminum-nickel powder fuse or a titanium-carbon powder fuse and operable to be activated to generate heat and increase the temperature of the matrix material during flight of the projectile such that the body at least partially disintegrates after a predeterminable time period and the particulate material is no longer held together in a single mass.

12. The projectile of claim 11, wherein composite material has a ratio of the particulate material to the matrix material of 1:1 to 1:2.

13. A projectile comprising:

a solid body formed of a composite material with at least one particulate material dispersed in a matrix material that includes a binder material comprising a material selected from the group consisting of polylactic acid (PLA) and bismuth-tin alloy, the body having a cavity therein; and a heat source located in the cavity of the body, the heat source being operable to be activated to generate heat and increase the temperature of the matrix material during flight of the projectile such that the body at least partially disintegrates after a predeterminable time period and the particulate material is no longer held together in a single mass.

* * * * *